United States Patent [19]

Babij et al.

[11] 4,008,477

[45] Feb. 15, 1977

[54] ANTENNA WITH INHERENT FILTERING ACTION

[75] Inventors: Tadeusz M. Babij, Wrocaw, Poland; Ronald R. Bowman; Paul F. Wacker, both of Boulder, Colo.

[73] Assignee: The United States of America as represented by the Secretary of Commerce, Washington, D.C.

[22] Filed: June 25, 1975

[21] Appl. No.: 590,355

[52] U.S. Cl. ..... 343/701; 343/802; 343/873

[51] Int. Cl.[2] ..... H01Q 1/42; H01Q 3/16

[58] Field of Search ..... 343/701, 703, 802, 873, 343/794, 792

[56] References Cited

UNITED STATES PATENTS

| | | | |
|---|---|---|---|
| 3,783,448 | 1/1974 | Brodwin | 343/703 |
| 3,805,269 | 4/1974 | Fujimoto et al. | 343/802 |

*Primary Examiner*—Alfred E. Smith
*Assistant Examiner*—David K. Moore
*Attorney, Agent, or Firm*—Eugene J. Pawlikowski; Alvin Englert

[57] ABSTRACT

A novel antenna is disclosed which provides inherent filtering action by which the frequency response curve of the antenna can be shaped. In the preferred inventive embodiment, the antenna comprises at least one elongated receiving element, and preferably two such elements in the form of a dipole, both elements being constructed, at least in part, of an electrically resistive material. A detector, such as a diode detector, is directly coupled to the receiving elements. The resistance of the receiving element and the capacitances of the receiving element and the detector form a distributed parameter RC filter, the values of which parameters can be carefully controlled so as to provide the desired frequency response curve shaping. In the preferred inventive embodiment, a conductive strip is disposed along the length of and preferably to both sides of each receiving element, with a layer of dielectric material being sandwiched therebetween, whereby the filtering action is enhanced.

1 Claim, 8 Drawing Figures

ANTENNA WITH INHERENT FILTERING ACTION

BACKGROUND OF THE INVENTION

This invention generally relates to antenna systems and is particularly concerned with the provision of a receiving antenna constructed so as to exhibit inherent filtering action to thereby shape the frequency response curve thereof.

Antenna systems of virtually any form generally exhibit characteristic frequency response curves due to the interaction of the impedances of the antenna itself, the detector therefor, and the associated transmission line coupled thereto. In many varieties of such antenna systems wherein the detector is not directly coupled to the antenna, the frequency response curve of the antenna system can be shaped to exhibit desired characteristics through the utilization of a lumped-parameter filter. However, in some antenna systems such as dipoles or other linear antennas, or loop antennas, the detector which typically constitutes a diode is so directly coupled to the antenna elements as to render impractical the utilization of a lumped-parameter filter to correct and shape the frequency response curve.

SUMMARY OF THE INVENTION

It is the primary objective of the instant invention to provide an antenna construction which eliminates the necessity of external lumped-parameter filters for frequency response curve shaping, such antenna still providing desired frequency response characteristics. Yet another objective of the instant invention is to provide an antenna of the type described wherein the frequency response characteristics thereof can readily be selected and modified as desired during the construction process.

These objectives as well as others which will become apparent as the description proceeds are implemented by the instant invention which is directed to the provision of an antenna of a construction so as to exhibit an inherent filtering action for shaping the frequency response curve thereof. The instant invention has primary applicability to dipoles or other linear antennas, or loop antennas to which a detector such as a diode is directly coupled. In accordance with the teachings herein, each of the elongated receiving elements of the antenna are constructed using electrically resistive material and an inherent filtering action is effected in that a distributed parameter RC filter is formed from the resistance of the receiving element, and the capacitances of the receiving element and the detector. Such filtering action is improved when the resistive receiving element is disposed in close proximity to a conductive strip, which strip can be separated from the receiving element by a layer of dielectric material sandwiched therebetween. By selecting the physical dimensions of the conductive strip and the dielectric material, variations in the parameters of the RC filter are obtained thus enabling the shaping of the frequency response curve of the antenna as desired.

A particular advantageous utilization of the technique of the instant invention is to eliminate the high-frequency peak typically associated with dipole antennas to which a detector is directly coupled. An alternative utility of the instant invention requiring the utilization of normal conductive receiving elements surrounded by a resistive shield is to provide low-frequency "roll-off".

BRIEF DESCRIPTION OF THE DRAWINGS

The invention will become better understood and further features and advantages thereof will be apparent from the following detailed description of the preferred inventive embodiments, such description referring to the appended sheets of drawings wherein.

Figure 3:
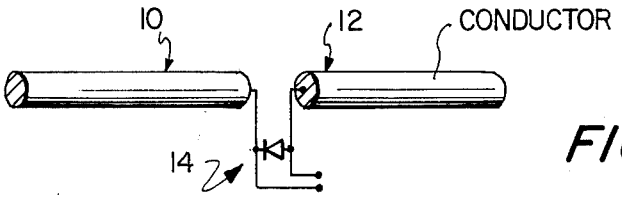
FIG. 3 is an illustration of a typical dipole antenna constructed in accordance with prior-art techniques.

DETAILED DESCRIPTION OF THE PREFERRED INVENTIVE EMBODIMENTS:

With reference now to FIG. 3 of the application drawins, a conventional antenna of the dipole type is illustrated, such antenna having two linear and elongated elements 10 and 12, each element being constructed, in typical fashion, of a good conductor such as metal. Again, in conventional fashion, and coupled to the arms or elements of the antenna in a direct manner is a detector, such as diode detector 14. When placed in a radiofrequency field, voltages are induced in each arm or element 10 and 12 of the dipole antenna, which induced antenna voltage is rectified by the detector or diode 14 to provide a direct current component representative of the response of the antenna-diode combination.

Figure 1:
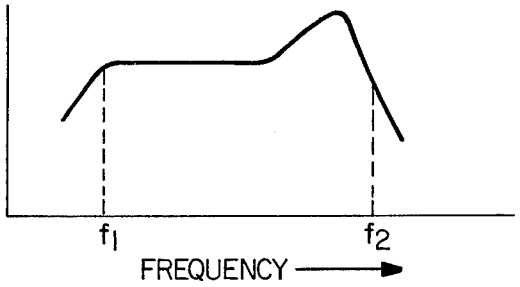
FIG. 1 is a graphical illustration of a frequency response curve typical of a conventional dipole antenna to which a detector such as a diode is directly coupled.

For a conventional dipole-diode as shown in FIG. 3, the antenna response is a function of frequency and exhibits the typical response curve as is illustrated in FIG. 1. As is evident, the response curve incorporates a resonance peak at the higher frequencies, which peak is, for some important applications, an undesirable characteristic.

Figure 2:
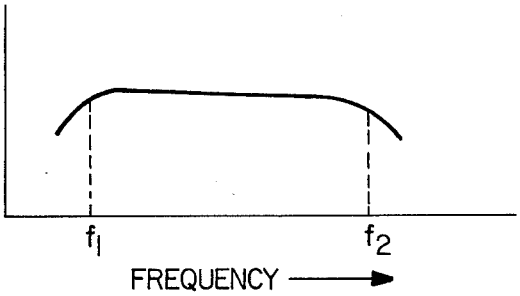
FIG. 2 is a frequency response as is obtained from a dipole antenna constructed in accordance with the teachings of the instant invention.

One of the main functions of the instant invention is to provide an antenna construction, such as a dipole antenna, which construction eliminates such resonance peak and provides a frequency response curve of the type illustrated in FIG. 2 of the application drawings. An antenna constructed in accordance with the instant invention and providing such a curve is the antenna illustrated in FIG. 4.

Figure 4:
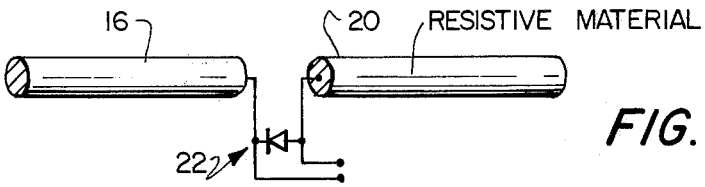
FIG. 4 is an illustration of a dipole antenna constructed in accordance with the primary teachings of the instant invention.

In this respect, and with reference to FIG. 4 of the application drawings, the dipole antenna depicted therein similarly has elongated receiving elements and, in this example, incorporates two arms 16 and 20. A detector 22 such as the illustrated diode is directly connected between the two arms 16 and 20 of the antenna. The distinction between the antenna of FIG. 4 constructed in accordance with the teachings of the instant invention, and the conventional antenna of FIG. 3, is that each of the elongated receiving elements 16 and 20 is fabricated of a resistive material such as compounds of carbon, as opposed to being fabricated of a good conductor such as metal. If the material of the receiving elements is sufficiently resistive, the resistance of the dipole or detector 22 constituting the antenna load and the capacitances of the dipole and the diode cause an inherent filtering action that differs from the typical resistance-capacitance filter only in that the resistance and part of the capacitance are distributed parameters rather than lumped parameters. With this inherent filtering action as will be effected by the basic inventive construction of FIG. 4, the energy available from the antenna at the higher frequencies is limited and the "resonance peak" typically associated with antennas of conventional construction is eliminated.

Figure 5:
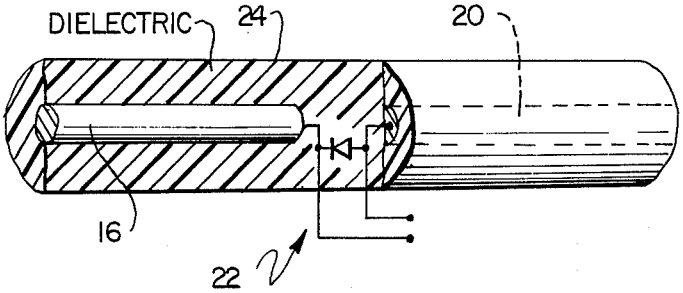
FIG. 5 is a side elevational view, partially in section, depicting one variant of the antenna construction of the instant invention.

A minor variant of the simple antenna of FIG. 4 is depicted in FIG. 5 of the application drawings wherein like parts are represented by the same reference numerals. Here, the basic dipole construction is encapsulated in a dielectric material 24 which has been found to be useful in obtaining the desired amount of distributed capacitances between the dipole arms.

With the simplified embodiments of FIGS. 4 and 5, a relatively weak inherent filtering action is obtained. A stronger filtering action can be provided with more complicated dipole construction by means of combinations of good conductors and resistive conductors or resistive materials as is shown in the variants of the instant invention of FIGS. 6 and 7. The alternative embodiments of FIGS. 6 and 7 operate in essentially the same manner as that discussed with respect to the simplified embodiments of FIGS. 4 and 5. For purposes of enhancing an understanding of these more complicated arrangements, a discussion of the antenna depicted in FIG. 6 of the application drawings now follows.

Figure 6:
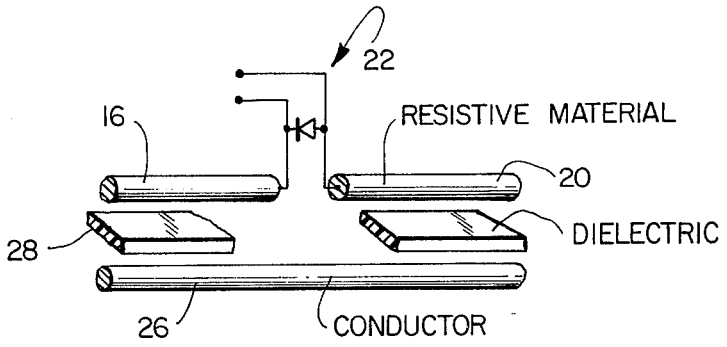
FIG. 6 is a perspective illustration depicting a further variant of an antenna constructed in accordance with the teachings of the instant invention.

With reference to FIG. 6, the embodiment therein essentially differs from that depicted in FIGS. 4 and 5 in that a good conductor such as the conductive strip or rod 26 is disposed along the antenna receiving elements 16 and 20 to one side thereof. The distributed capacitance between the resistive elements 16 and 20 of the dipole and the good conductor 26 provides a "shunt" path for the current flowing on the arms of the dipole. Preferably, though optionally, a strip of dielectric material 28 is sandwiched therebetween as is shown, such dielectric material facilitating the achievement of the desired amount of distributed capacitance between the dipole arms and the good conductor.

As the frequency of the radio-frequency field in which the antenna is placed increases, the impedance of this shunt path decreases because of the decreasing impedance of the distributed capacitance between the resistive arms 16 and 20 and the good conductor 26. Thus, with increasing frequency, more of the induced currents along the dipole are shunted away from the diode detector 22 or whatever other load is placed between the terminals of the antenna, and less radio-frequency energy is available to the diode than would be available if the good conductor was removed.

By varying the length of the conductor 26, and the physical disposition and extent of the dielectric 28, a variation in the electrical characteristics of the RC distributed parameter filter can be obtained, thus varying the frequency response of the antenna.

Figure 7:
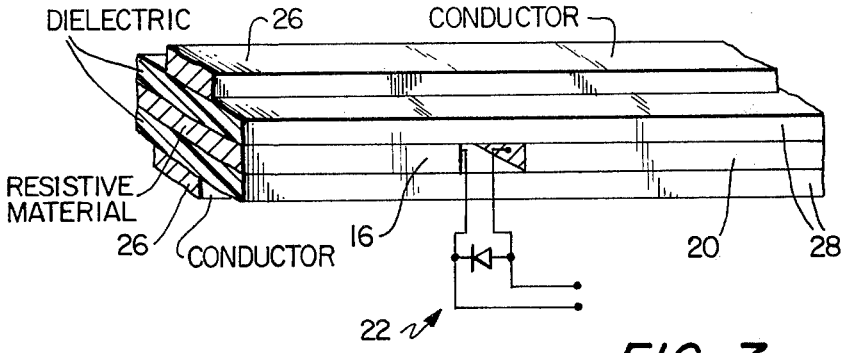
FIG. 7 is a perspective illustration depicting still another variant of the antenna constructed in accordance with the teachings of the instant invention.

With reference to the embodiment of the antenna depicted in FIG. 7 of the application drawings, the arms of the dipole 16 and 20 are formed as flattened strips, as is the good conductor 26 and, further, a conductor 26 is disposed to opposing sides of the resistive material constituting the arms 16 and 20 of the dipole and the dielectric strip 28 is sandwiched between each such conductor and receiving element.

Figure 8:
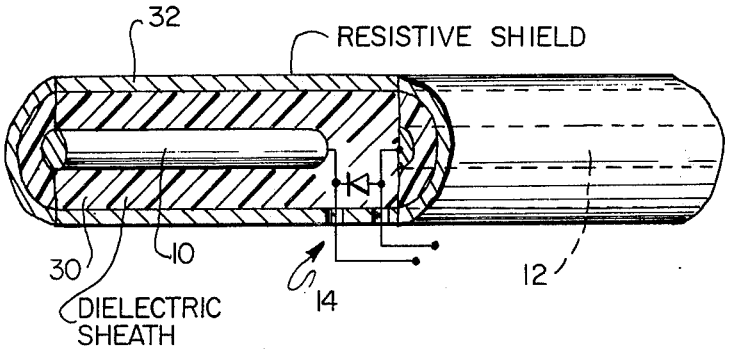
FIG. 8 is an elevational view, partially in section, depicting yet another antenna constructed in accordance with the specialized teachings of the instant invention whereby low frequency roll-off can be obtained.

Each of the antenna constructions as above-discussed primarily exhibit inherent filtering action by whih the higher-frequency response characteristics of the antenna are altered. A low-frequency roll-off antenna can be achieved in accordance with an alternative construction as is depicted in FIG. 8. In this construction, a conventional dipole antenna is utilized constituting arms 10 and 12 of good conductive material to which a detector 14 such as a diode is connected, in the same fashion as was discussed with respect to FIG. 3 of the application drawings and, as such, similar reference numerals have been used. This conventional dipole antenna is contemplated to be surrounded by a dielectric sheath 30 and then surrounded by a resistive shield 32 as is shown. With decreasing frequency, the resistive shield becomes increasingly effective, and the radio-frequency currents on the dipole arms are reduced. With proper empirical design, the resistive shield will have negligible effect at the higher operating frequencies of the antenna.

The teachings of the instant invention as above-discussed can be extended for application in an obvious manner to antennas that are comprised of arrays of dipoles and linear antenna elements, typical examples of such antennas being conventional frequency-modulation radio antennas or television antennas. Further, the teachings of the instant invention have applicability to magnetic loop antennas in a fashion obvious to those skilled in the art. Further, it should be understood that while the detectors discussed above have been illustrated as comprising diodes, a thermocouple detector or other RF detector could be placed at the terminals of the antenna, as well as other loads.

Thus, while preferred inventive embodiments have been described in detail, those skilled in the art will recognize the obvious extensions of the principles taught herein and the scope of the instant invention is to be construed in accordance with the scope of the appended claims.

What is claimed is:

1. An antenna with inherent filtering action for shaping the frequency response curve thereof, said antenna comprising, in combination, at least one elongated receiving element constructed of an electrically-conductive material; a dielectric sheath surrounding said receiving element; a resistive shield surrounding said dielectric sheath, and a detector directly coupled to said receiving element; whereby a distributed parameter RC filter is formed decreasing the low-frequency response of said antenna.

* * * * *